US005966933A

United States Patent [19]

Ishihara et al.

[11] Patent Number: 5,966,933

[45] Date of Patent: Oct. 19, 1999

[54] COVERING UNIT FOR MOTORCYCLE EXHAUST SYSTEM

[75] Inventors: Satoshi Ishihara; Shinichi Ookawa, both of Saitama, Japan

[73] Assignee: Honda Giken Kogyo Kabushiki Kaisha, Tokyo, Japan

[21] Appl. No.: 08/932,011

[22] Filed: Sep. 17, 1997

[30] Foreign Application Priority Data

Sep. 20, 1996 [JP] Japan ..... 8-249417

[51] Int. Cl.[6] ..... F01N 7/00

[52] U.S. Cl. ..... 60/322; 60/323; 180/309; 285/330

[58] Field of Search ..... 60/322, 323; 180/219, 180/225, 309; 181/212; 285/330, 913, 914

[56] References Cited

U.S. PATENT DOCUMENTS 3,889,984 6/1975 Lambiris ..... 285/330
4,471,853 9/1984 Callaghan et al. ..... 180/309
4,699,232 10/1987 Nebu et al. .
5,396,767 3/1995 Suzuki ..... 60/299
5,568,726 10/1996 Yamada et al. ..... 60/323

FOREIGN PATENT DOCUMENTS

Y2-6332895 9/1988 Japan .

*Primary Examiner*—Thomas E. Denion
*Attorney, Agent, or Firm*—Birch, Stewart, Kolasch & Birch, LLP

[57] ABSTRACT

A motorcycle exhaust system, which can prevent the generation of noise by vibrations and interference of an exhaust pipe heat insulating cover and a muffler heat insulating cover for protecting exhaust pipes and a muffler. Exhaust pipes and a muffler are protected by an exhaust pipe heat insulating cover and a muffler heat insulating cover, and confronting ends of the covers and are joined via an elastic member.

17 Claims, 7 Drawing Sheets

COVERING UNIT FOR MOTORCYCLE EXHAUST SYSTEM

BACKGROUND OF THE INVENTION

1. Field of the Invention

The present invention relates to a covering unit for a motorcycle exhaust system comprising exhaust pipes connected to an engine mounted on a body frame of a motorcycle and extending rearwardly. A muffler is mounted on the with rear end of the exhaust pipes.

2. Description of Background Art

In a motorcycle including exhaust pipes extending to an exhaust port and mufflers, the exhaust pipes are usually protected by a heat insulating cover in order to provide insulation from hot exhaust gases. See Japanese Utility Model Publications No. Sho. 63-32895 and No. Hei 311371.

In order to promote heat insulation of the foregoing covering unit, it is conceivable to protect the exhaust pipes and the muffler of the motorcycle with separate heat insulating covers. The heat insulating cover for the exhaust pipes and that for the muffler are different in size, shape, etc. It is very difficult to join such insulating covers by welding a tightening band or the like in order to make them integral. Therefore, it is inevitable that confronting ends of the heat insulating covers are not joined and remain free.

Usually, the foregoing heat insulating covers are made of thin heat resisting plates. Therefore, when vibrations caused by the operation of the engine or running of the motorcycle are transmitted to the heat insulating covers, beat noise will be generated at the free ends of the heat insulating covers. Further, the free ends of the heat insulating covers will interfere with each other and generate interference noise. Both the beat noise and interference noise will increase traffic noise. In order to overcome this problem, it is necessary to reinforce the heat insulating covers, which may increase their weight and cost. This is a further problem to be solved.

SUMMARY AND OBJECTS OF THE INVENTION

The present invention provides a novel covering unit for a motorcycle exhaust system. The covering unit includes a heat-insulating cover for exhaust pipes and a muffler which can overcome the problems of the related art.

In order to accomplish the foregoing object, a covering unit is applied to a motorcycle exhaust system comprising exhaust pipes connected to an engine mounted on a body frame of the motorcycle and extending rearward and a muffler coupled to the rear ends of the exhaust pipes. The covering unit is characterized in that the exhaust pipes and the muffler are respectively protected by an exhaust pipe heat insulating cover and a muffler heat-insulating cover, and the exhaust pipe heat insulating cover and the muffler heat insulating cover are detachably plugged into each other at confronting ends thereof via an elastic member near a position where the exhaust pipes join with the muffler. This arrangement enables the exhaust pipe heat-insulating cover and the muffler heat insulating cover to be joined without interference even when they are of different sizes. This arrangement is effective in preventing the generation of noise by vibrations of the covers and protecting the covers against being damaged by interference therebetween.

The covering unit for the muffler heat-insulating cover and the muffler are supported by an elastic member in such a manner that the front ends of the muffler heat insulating cover and the muffler are relatively movable back and forth. The muffler heat insulating cover and the muffler are integral with each other at rear ends thereof. Thus, it is easy to assemble the exhaust pipe heat insulating cover and the muffler heat insulating cover to the exhaust system of the motorcycle. The heat insulating covers and the muffler are free from positional displacement therebetween. Further, it is possible to absorb thermal stress caused by a difference in thermal expansion between the heat insulating cover and the muffler.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The invention will be described with reference to an embodiment shown on the accompanying drawing figures.

Figure 1:
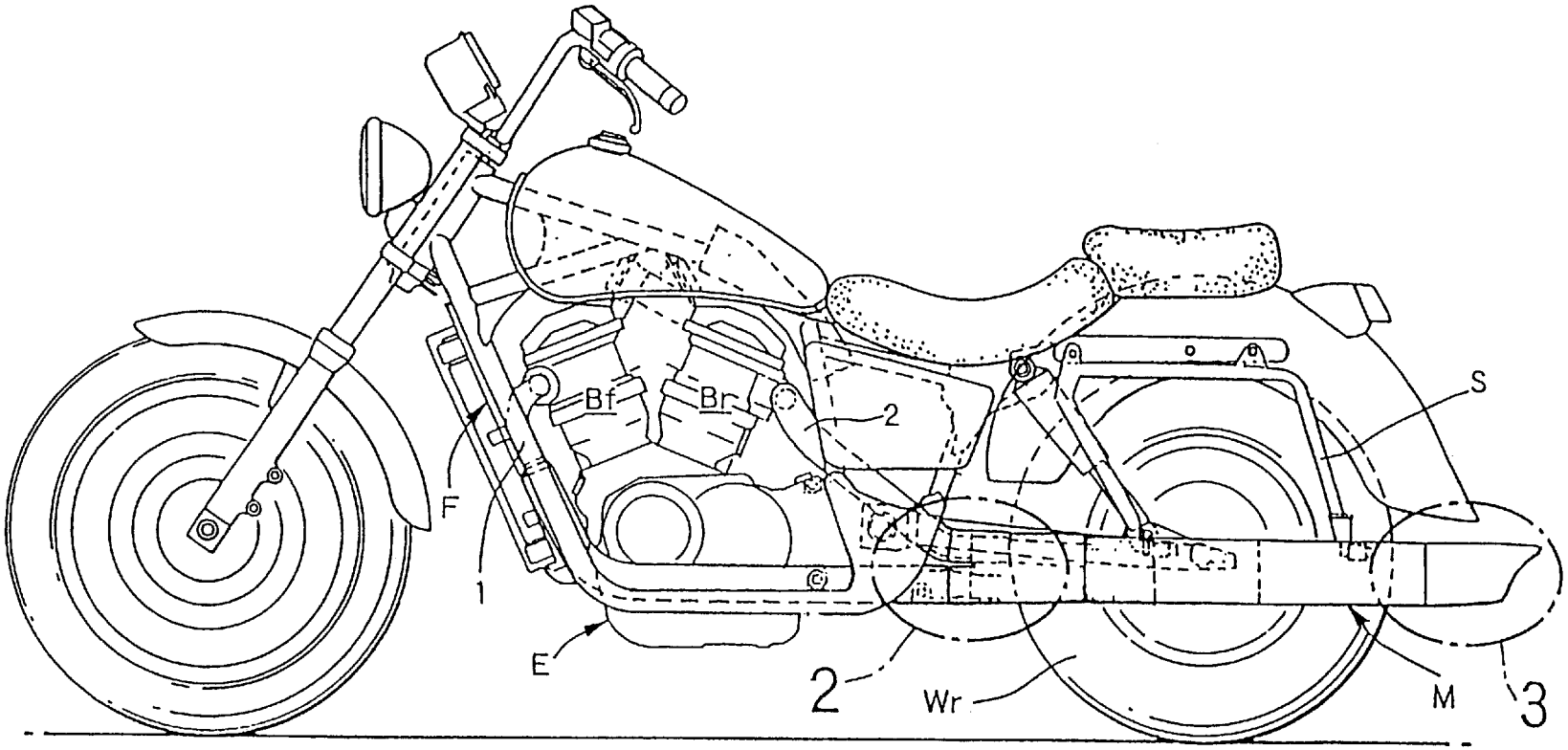
FIG. 1 is a side elevation of a motorcycle including a covering unit for an exhaust system, according to the present invention.

Referring to FIG. 1, V-type multi-cylinder four-stroke engine E is mounted. A front bank Bf slopes forwardly, and a rear bank Br slopes rearwardly. An output shaft of the engine E is interlocked to a rear wheel Wr via a power transmission mechanism. A front exhaust pipe 1 communicates with an exhaust port which is open at the front part of the front bank Bf while a rear exhaust pipe 2 communicates with another exhaust port which is open behind the rear bank Br. The front exhaust pipe 1 extends downwardly along the front portion of the engine E and then remains substantially horizontal towards the rear of the motorcycle. The rear exhaust pipe 2 extends downwardly to the rear of the motorcycle. Both the front and rear exhaust pipes 1 and 2 come near each other at their rear ends and extend substantially parallel to each other to the rear of the motorcycle. A muffler M supported by a stay S joins via its front end with the rear ends of the front and rear exhaust pipes 1 and 2.

A structure for joining the front and rear exhaust pipes 1 and 2 to the muffler M will be described in detail mainly referring to FIGS. 2 and 4. The front and rear exhaust pipes 1 and 2 include female couplers 3 and 4 at their rear ends, respectively. The female couplers 3 and 4 are thick at their rear halves, which have slits $3_1$ and $4_1$, and guides 32 and 42 fanning out at their rear ends.

The muffler M includes a pair of male couplers 5 and 6 attached to the periphery of the front end wall Mf. The male couplers 5 and 6 extends forwardly from the muffler M, and are detachably joined to the female couplers 3 and 4. A sealing member 8 is filled in an annular space 7 defined by the inner surfaces of the female couplers 3 and 4, and the outer surfaces of the male couplers 5 and 6, thereby preventing leakage of exhaust gases. The male couplers 5 and 6 have necks $5_1$ and $6_1$ on their outer surfaces near an outer end of the sealing member 8. A push member 9 surrounds the necks $5_1$ and $6_1$ of the male couplers 5 and 6, thereby keeping the sealing member 8 at its predetermined position. The female couplers 3 and 4, respectively, have bands 10, 10 with clamping bolts 11, 11, and are connected to the male couplers 5, 6 by tightening the bands 10 and 10, so that these couplers are integral with one another. Thus, the front and rear exhaust pipes 1 and 2 and the muffler M becomes integral with one another.

An exhaust pipe heat-insulating cover 12 has a transverse cross section in the shape of a superior arc, and is attached, via a stay 13 with rubber, to the outer rear surface of the front and rear exhaust pipes 3, 4, i.e. to the exhaust pipe 2 which is far from the body frame F. As most clearly shown in FIG. 4, the heat insulating cover 12 has two support members 15, 15 welded on its inner surface with a space kept therebetween. The support members 15, 15, which are in the shape of a hollow prism and have open ends, house rubber mountings 16, 16 as heat-insulating elastic members. The rubber mountings 16, 16 have openings $16_1$, $16_1$ on their rear ends. The front ends of the muffler M and the muffler heat insulating cover 18 are fitted into these openings $16_1$, $16_1$ as described later.

Figure 2:
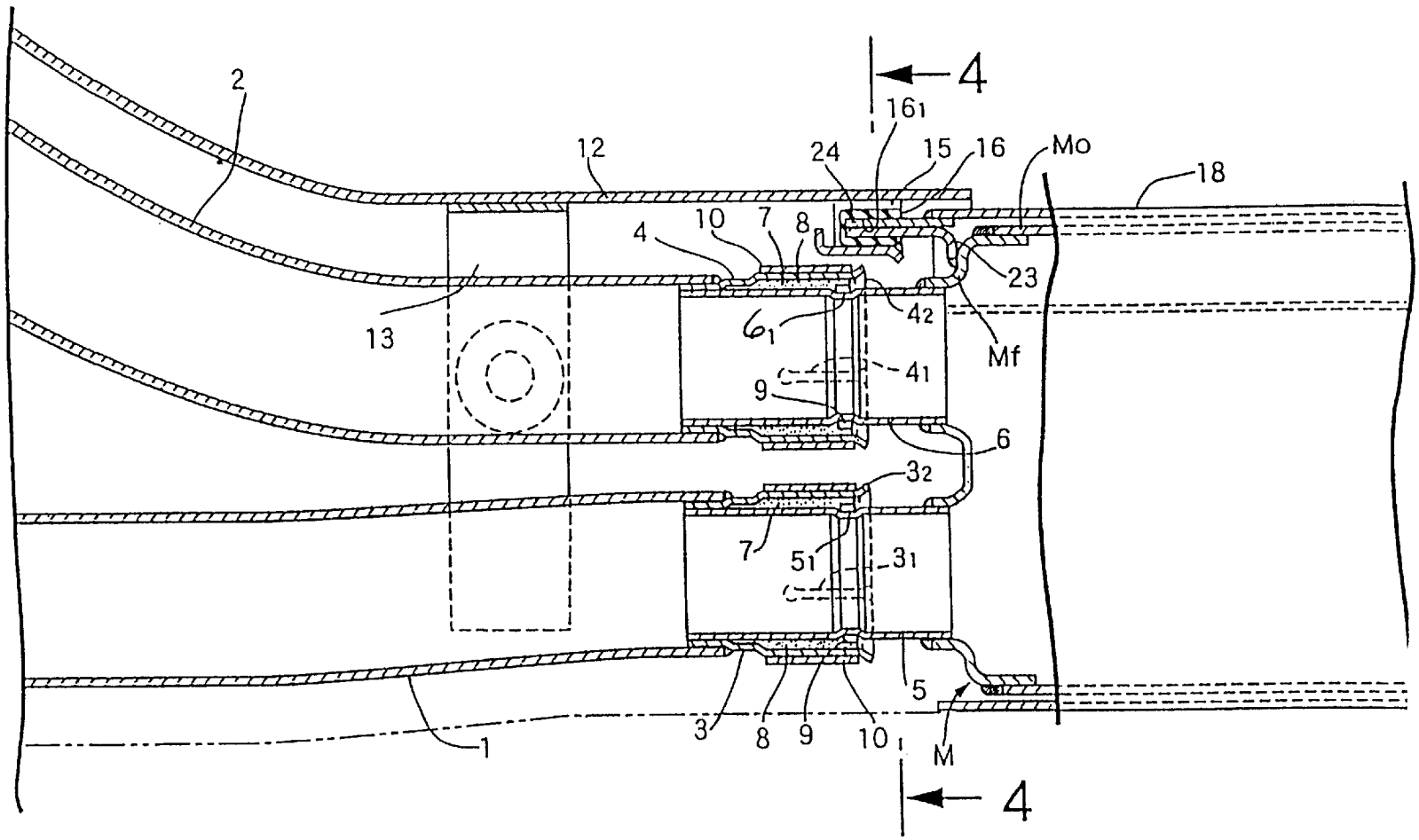
FIG. 2 is an enlarged cross section of a portion of the connection as illustrated in FIG. 1.
Figure 3:
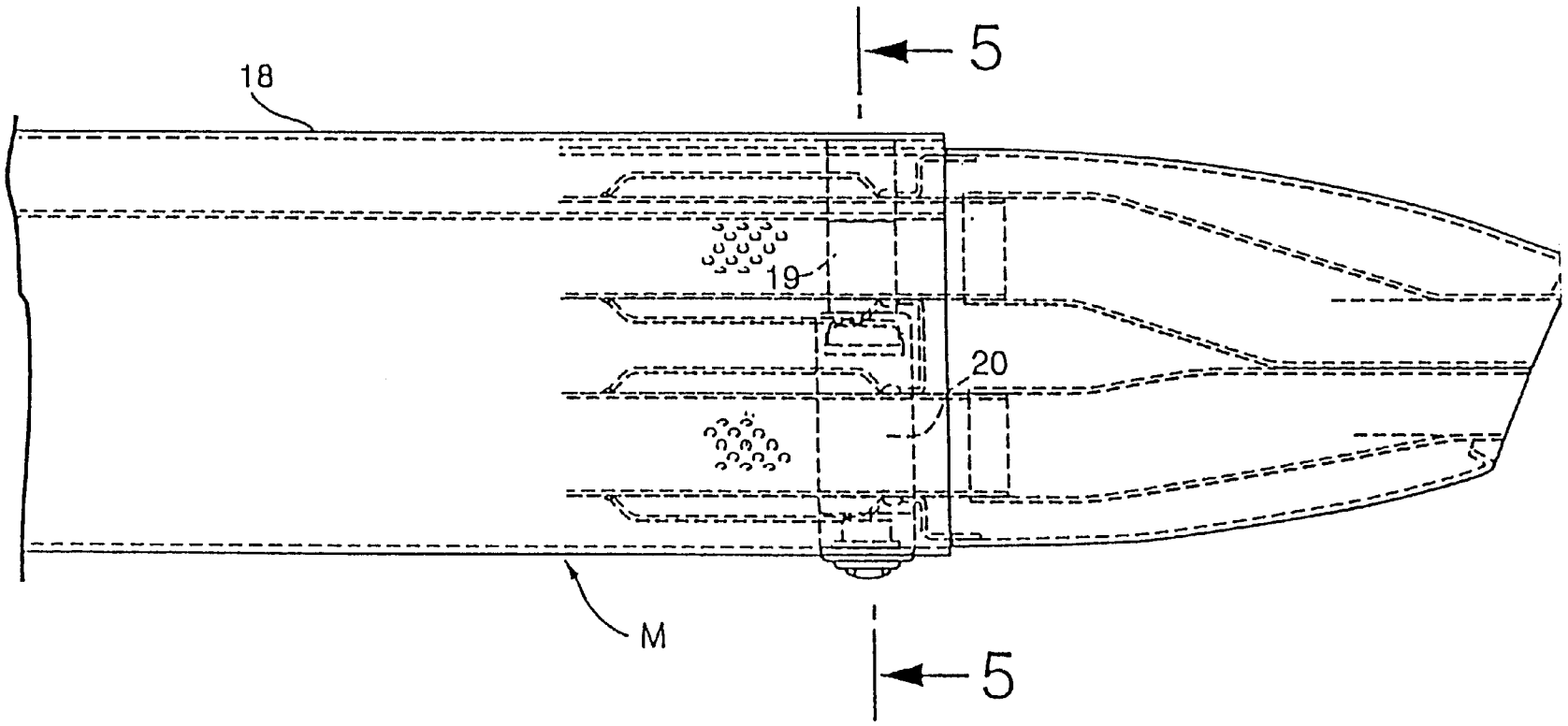
FIG. 3 is an enlarged view of a portion of the connection as illustrated in FIG. 1.
Figure 5:
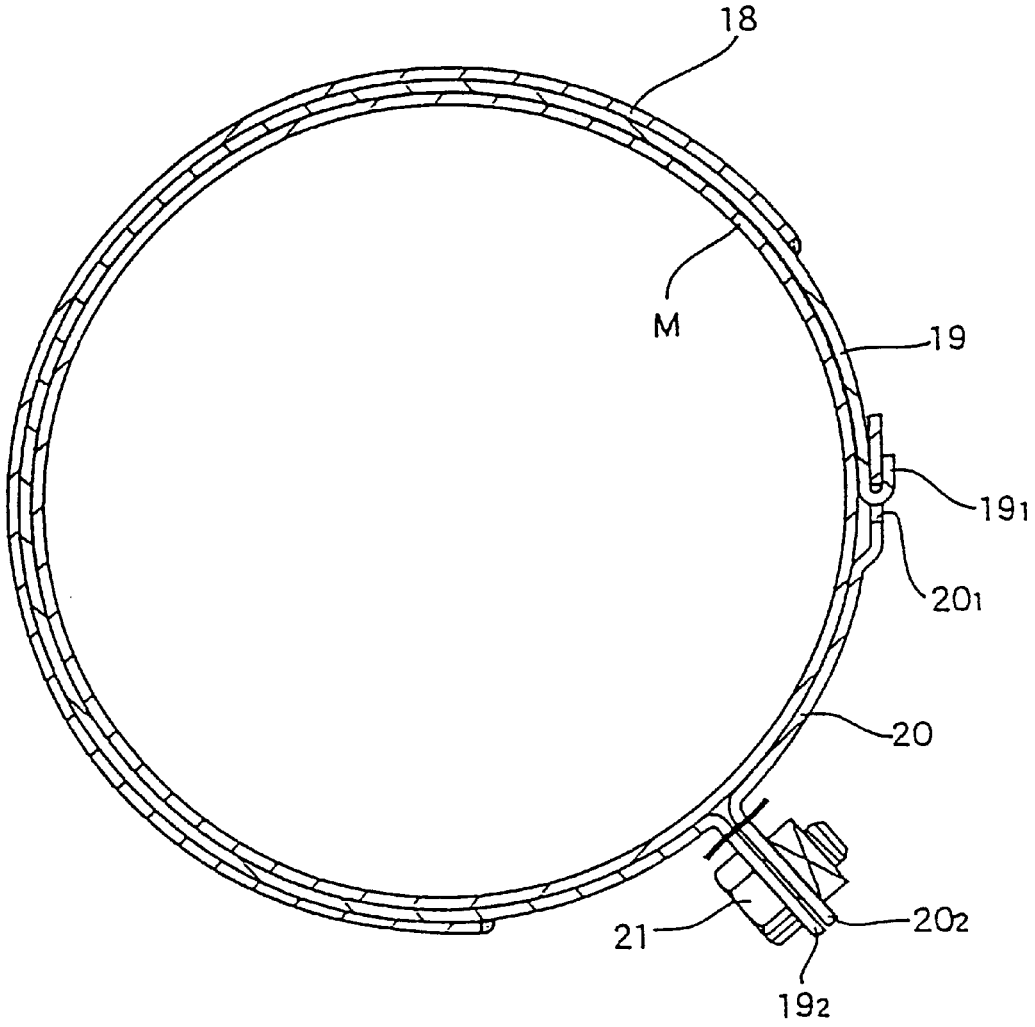
FIG. 5 is a transverse cross-sectional view taken along line 5—5 in FIG. 3.

Referring to FIGS. 2, 3 and 5, an outer half of a cylinder Mo around the cylindrical muffler M, i.e., the outer half which is far from the body of the motorcycle, is surrounded by the muffler heat insulating cover 18. The muffler heat-insulating cover 18, made of a heat insulating plate, is in the shape of a superior arc, and has a metal strip 19 welded on a rear inner surface thereof. The metal strip 19 has a hook $19_1$ at its one end, and a tightening piece $19_2$ at the other end. The tightening piece $19_2$ extends outwardly from the metal strip 19. The hook $19_1$ is detachably engaged in a hole $20_1$ formed on one end of the tightening band 20 in the shape of a superior arc. Another tightening piece $20_2$ projecting from the other end of the tightening band 20 confronts with the tightening piece $19_2$. The tightening pieces $19_2$ and $20_2$ are tightened using the bolt 21, so that the rear ends of the muffler heat insulating cover 18 and the outer cylinder Mo of the muffler M are tightened so as to be integral with each other.

Alternatively, a metal strip may be welded to the rear end of the muffler heat insulating cover 18 so that the rear end of the heating insulating cover 18 may be welded to the rear end of the outer cylinder Mo.

Figure 4:
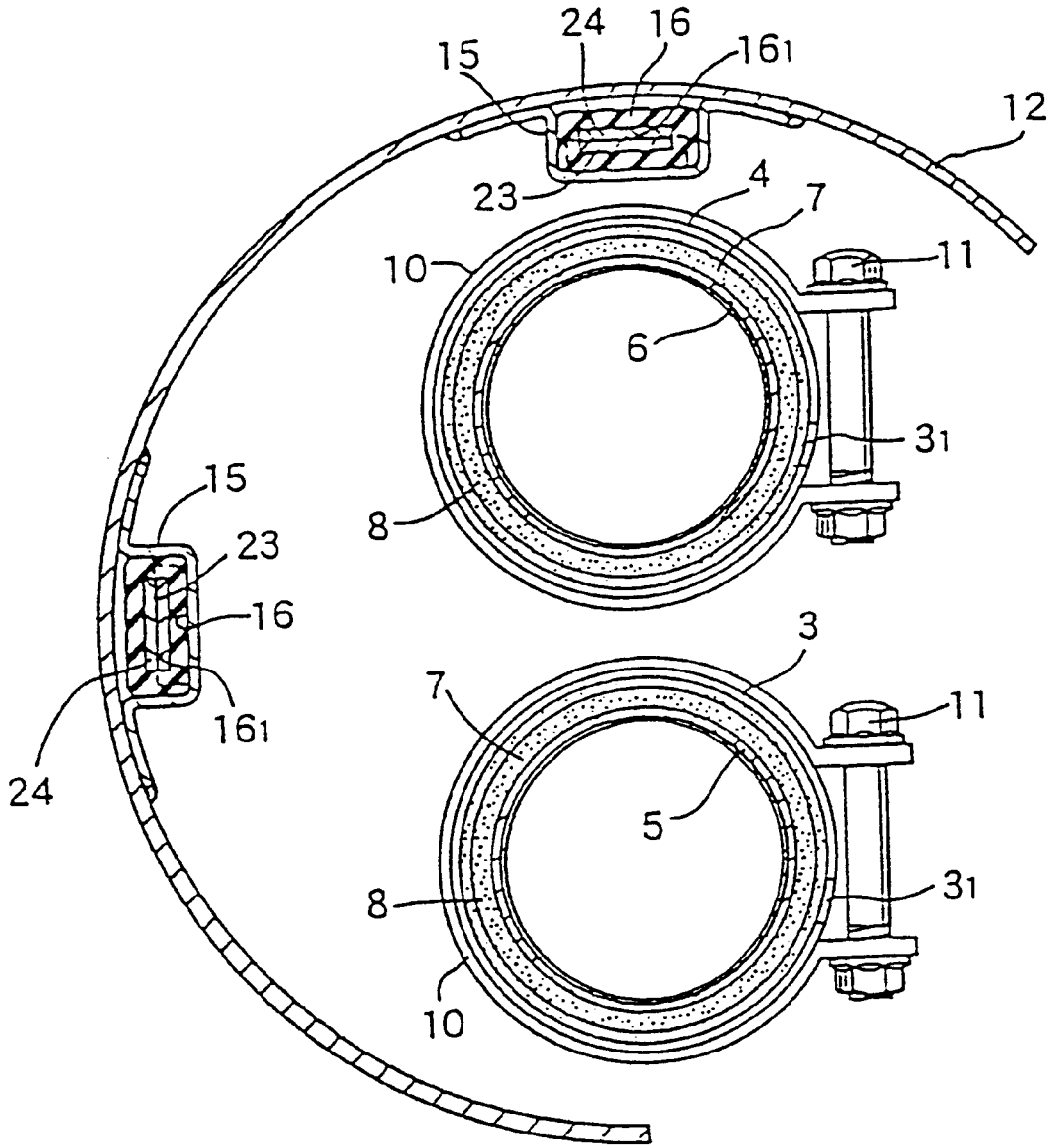
FIG. 4 is a transverse cross-sectional view taken along line 4—4 in FIG. 2.

As shown in FIGS. 2 and 4, two coupling pieces 23, 23 are welded on the outer surface of the front wall Mf of the muffler M, with a predetermined space kept therebetween. Two coupling pieces 24, 24 are provided on the front peripheral edge of the muffler heat insulating cover 18, with a predetermined space kept therebetween. The two pairs of the coupling pieces 23 and 24 and 23 and 24 are piled up in such a manner that they are slidable back and forth, and project forward. The front ends of the coupling pieces 23, 24 and 23, 24 are slidably fitted into the opening $16_1$, $16_1$ on the rubber mountings 16, 16 which are at the rear ends of the exhaust pipe heat insulating covers 12, 12. Thus, the front ends of the muffler M and the muffler heat insulating cover 18 are elastically supported by the rear ends of the exhaust pipe heat insulating cover 12 via the rubber mountings 16, 16, near the position where the front and rear exhaust pipes 1 and 2 join with the muffler M. The muffler M and the muffler heat insulating cover 18 are mutually slidable back and forth. Therefore, it is possible to prevent the free ends of the heat insulating covers 12 and 18 from vibrating during the running of the motorcycle, and from interfering with each other. Further, even when the rear ends of the muffler M and the muffler heat insulating cover 18 are integral with each other, the front ends of these members can be relatively movable back and forth. Therefore, it is possible to absorb thermal stress caused by the difference in thermal expansion of the muffler M and the muffler heat insulating cover. The muffler M and the muffler heat insulating cover 18 are free from relative positional displacement.

The muffler M has an internal structure which is the same as that of the related art, and will not be described here.

Figure 6:
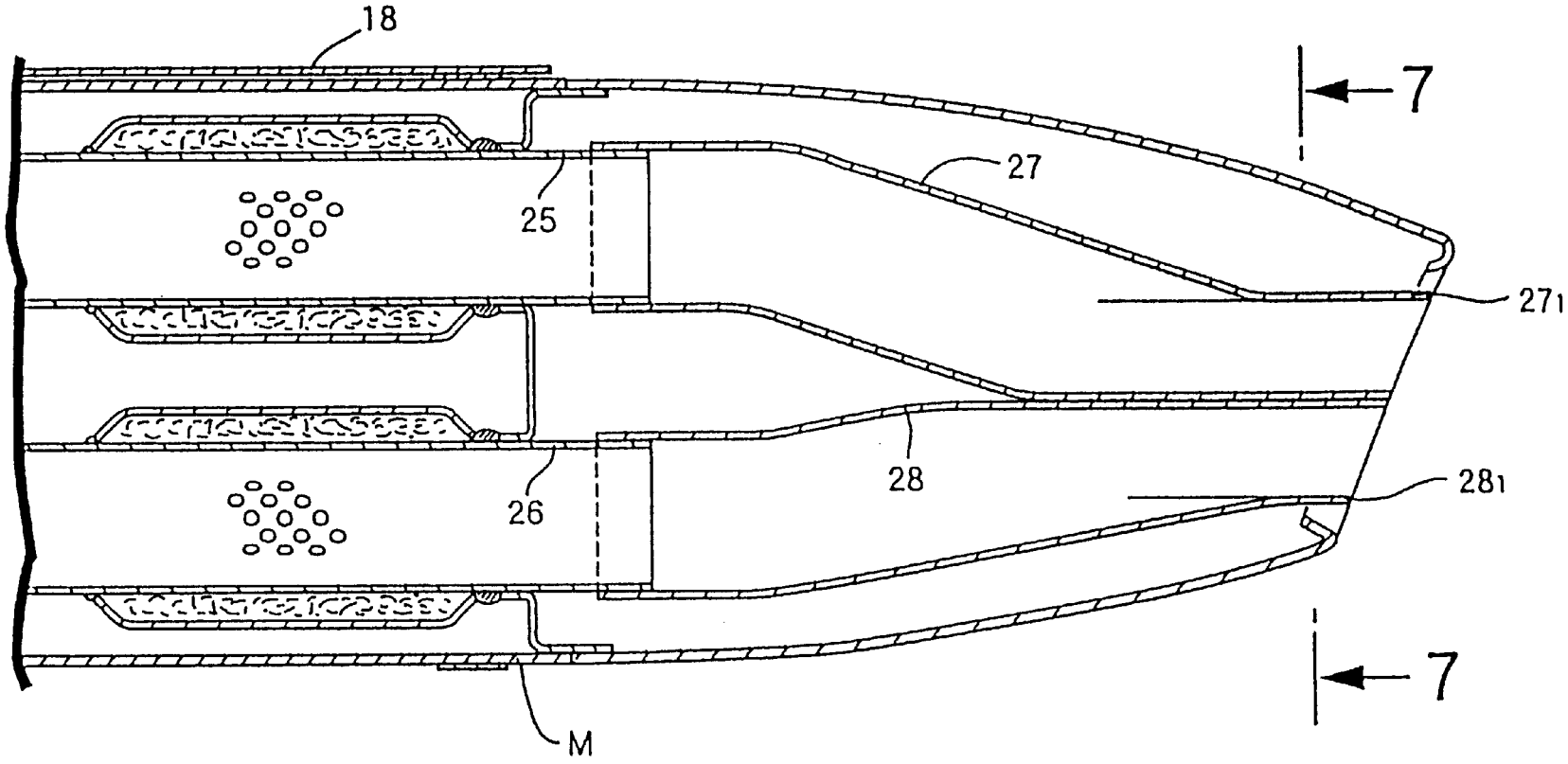
FIG. 6 is an enlarged cross section of the portion shown in FIG. 3.
Figure 7:
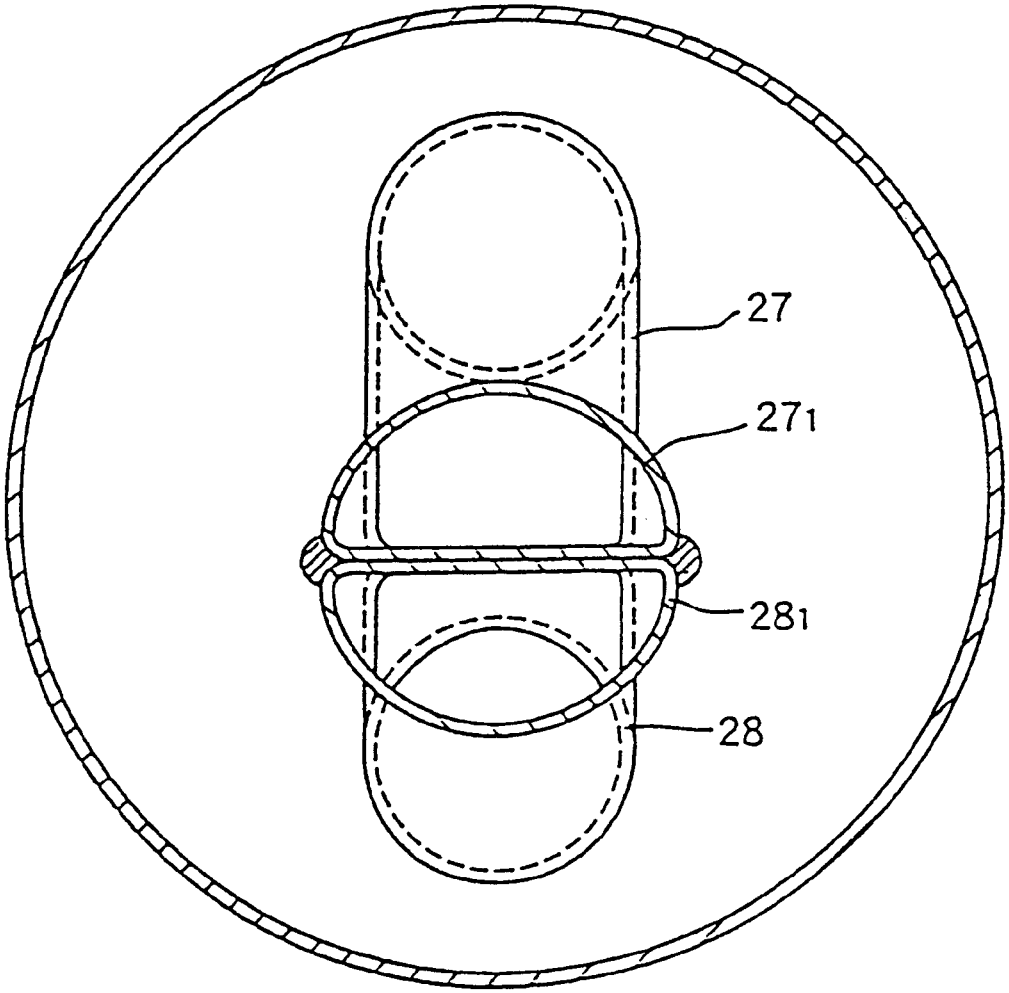
FIG. 7 is an enlarged cross-sectional view taken along line 7—7 in FIG. 6.

Referring to FIGS. 6 and 7, the muffler M houses two rear inner pipes 25 and 26, to which tail pipes 27 and 28 are connected. Downstream ends $27_1$ and $28_1$ of the tail pipes 27 and 28 are pressed at their upper and lower parts such that they have a semi-circular cross section, and are joined at their flat portions. Thus, the muffler M is shaped so as to have an attractive appearance at the rear end.

When the engine E of the motorcycle is running, exhaust gases from the engine E pass through the front and rear exhaust pipes 1 and 2, are muffled by the muffler M, and are scattered into the atmosphere. In this case, vibrations caused by the operating engine E and the running motorcycle are transmitted to the exhaust system which includes the front and rear exhaust pipes 1 and 2, and the muffler M. However, the free ends of the exhaust pipe heat insulating cover 12 and the muffler heat insulating cover 18 are interlocked via the rubber mountings 16, 16, which prevent the generation of noise due to vibrations. Further, the heat-insulating covers 12 and 18 do not interfere with each other. In addition, the thermal stress caused by the difference in thermal expansions of the muffler M and the muffler heat insulating cover 18 is offset by the coupling pieces 23 and 24 which are relatively slidable. The muffler M and the muffler heat insulating cover 18 are not relatively displaced.

The invention being thus described, it will be obvious that the same may be varied in many ways. Such variations are not to be regarded as a departure from the spirit and scope of the invention. For instance, the present invention is described to be applicable to the exhaust system of a V-type engine. Alternatively, the invention is also applicable to exhaust systems for engines of other types. Further, the covering unit is applied to the front and rear exhaust pipes and the muffler which are connected. Still further, it is applicable to an exhaust system including one exhaust pipe or three or more exhaust pipes, and a muffler which are interlocked.

In the covering unit according to the invention, the exhaust pipes and the muffler are, respectively, protected by the exhaust pipe heat insulating cover and the muffler heat insulating cover. These heat insulating covers are detachably connected at confronting ends thereof via the elastic member near the position where the exhaust pipes join with the muffler. Therefore, an exhaust pipe heat insulating cover and muffler heat insulating cover which are different in size and shape can be coupled via the elastic members, which are effective in preventing the generation of noise caused by vibrations of the heat insulating covers.

In this covering unit, the muffler and the muffler heat insulating cover are supported by the elastic member in such a manner that front ends of these members are relatively movable back and forth. Further, the muffler heat insulating cover and the muffler are integral with each other at rear ends thereof. Thus, it is easy to assemble an exhaust system including an exhaust pipe heat insulating cover and a muffler heat insulating cover. Further, when the muffler heat insulating cover and the muffler are made integral, it is possible to absorb the thermal stress caused by the difference between thermal expansions of the foregoing members.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A covering unit for a motorcycle exhaust system comprising:

exhaust pipes connected to an engine mounted on a body frame of a motorcycle and extending rearwardly;

a muffler coupled to the rear ends of said exhaust pipes;

an exhaust pipe heat insulating cover for protecting said exhaust pipes and said muffler; and a muffler heat insulating cover;

said exhaust pipe heat insulating cover and said muffler heat insulating cover being detachably plugged into each other at confronting ends thereof via an elastic member near a position where said exhaust pipes join with said muffler.

2. The covering unit according to claim 1, wherein said muffler heat insulating cover and said muffler are supported by said elastic member wherein front ends of said muffler heat insulating cover and said muffler are relatively movable back and forth, and said muffler heat insulating cover and said muffler are integral with each other at rear ends thereof.

3. The covering unit according to claim 1, and further including at least one coupling member secured to said exhaust pipe heat insulating cover and said muffler heat insulating cover for retaining said exhaust pipe heat insulating cover and said muffler heat insulating cover relative to each other.

4. The covering unit according to claim 3, wherein said elastic member is disposed within said at least one coupling member for preventing vibration between said exhaust pipe heat insulating cover and said muffler heat insulating cover.

5. The covering unit according to claim 3, wherein said coupling member secured to said exhaust pipe heat insulating cover includes at least one of a female connector and a male connector slidable relative to each other and said coupling member secured to said muffler heat insulating cover includes at least one of a male connector and a female connector slidable relative to each other for securing said exhaust pipe heat insulating cover and said muffler heat insulating cover relative to each other.

6. The covering unit according to claim 1, wherein said exhaust pipe includes a connecting end having at least one of a slit and a guide and said muffler includes a connecting end having at least one of a guide and a slit for securing said exhaust pipe and said muffler together.

7. The covering unit according to claim 6, wherein a sealing member is disposed between said connecting end of said exhaust pipe and said connecting end of said muffler for providing an air tight connection therebetween.

8. The covering unit according to claim 6, and further including tightening bands and clamping bolts for securely mounting said connecting end of said exhaust pipe and said connecting end of said muffler relative to each other.

9. The covering unit of claim 1, wherein at least one connector member of said muffler heat insulating cover is sheathably receivable by said elastic member.

10. A covering unit for an exhaust system comprising:

an exhaust pipe heat insulating cover for protecting an exhaust pipe and a muffler; and a muffler heat insulating cover;

said exhaust pipe heat insulating cover and said muffler heat insulating cover being detachably connected at confronting ends thereof via an elastic member near a position where at least one exhaust pipe joins with the muffler.

11. The covering unit according to claim 10, wherein said muffler heat insulating cover and said muffler are supported by said elastic member wherein front ends of said muffler heat insulating cover and said muffler are relatively movable back and forth, and said muffler heat insulating cover and the muffler are integral with each other at rear ends thereof.

12. The covering unit according to claim 10, and further including at least one coupling member secured to said exhaust pipe heat insulating cover and said muffler heat insulating cover for retaining said exhaust pipe heat insulating cover and said muffler heat insulating cover relative to each other.

13. The covering unit according to claim 12, wherein said elastic member is disposed within said at least one coupling member for preventing vibration between said exhaust pipe heat insulating cover and said muffler heat insulating cover.

14. The covering unit according to claim 11, wherein said coupling member secured to said exhaust pipe heat insulating cover includes at least one of a female connector and a male connector slidable relative to each other and said coupling member secured to said muffler heat insulating cover includes at least one of a male connector and a female connector slidable relative to each other for securing said exhaust pipe heat insulating cover and said muffler heat insulating cover relative to each other.

15. The covering unit according to claim 10, wherein the at least one exhaust pipe includes a connecting end having at least one of a slit and a guide and the muffler includes a connecting end having at least one of a guide and a slit for securing said at least one exhaust pipe and said muffler together.

16. The covering unit according to claim 15, wherein a sealing member is disposed between said connecting end of the at least one exhaust pipe and said connecting end of the muffler for providing an air tight connection therebetween.

17. The covering unit according to claim 15, and further including tightening bands and clamping bolts for securely mounting said connecting end of the at least one exhaust pipe and said connecting end of the muffler relative to each other.

* * * * *